US009102426B2

(12) United States Patent
Edwards et al.

(10) Patent No.: US 9,102,426 B2
(45) Date of Patent: Aug. 11, 2015

(54) FORM-FILL-SEAL MACHINE INCLUDING A FILLING TUBE WITH AN ELLIPTICAL CROSS-SECTION

(75) Inventors: Eduard Edwards, Arlington, TX (US); Joseph Paul Sagel, Plano, TX (US)

(73) Assignee: FRITO-LAY NORTH AMERICA, INC., Plano, TX (US)

( * ) Notice: Subject to any disclaimer, the term of this patent is extended or adjusted under 35 U.S.C. 154(b) by 798 days.

(21) Appl. No.: 13/345,062

(22) Filed: Jan. 6, 2012

(65) Prior Publication Data

US 2013/0174523 A1 Jul. 11, 2013

(51) Int. Cl.

| | |
|---|---|
| ***B65B 61/18*** | (2006.01) |
| ***B65B 9/20*** | (2012.01) |
| ***B65B 9/22*** | (2006.01) |
| ***B65B 9/213*** | (2012.01) |

(52) U.S. Cl.

CPC ..... *B65B 9/22* (2013.01); *B65B 9/2056* (2013.01); *B65B 9/213* (2013.01); *B65B 61/188* (2013.01); *B65B 9/2028* (2013.01)

(58) Field of Classification Search

CPC ..... B65B 9/20; B65B 9/2021; B65B 9/2035; B65B 9/22; B65B 9/213; B65B 9/207; B65B 61/188

USPC ..... 53/550, 551, 133.4, 139.2

See application file for complete search history.

(56) References Cited

U.S. PATENT DOCUMENTS

| | | | | | |
|---|---|---|---|---|---|
| 2,872,762 | A | * | 2/1959 | Dreeben | 53/551 |
| 3,425,185 | A | * | 2/1969 | Samways et al. | 53/552 |
| 3,494,265 | A | * | 2/1970 | Middour | 493/302 |
| 3,636,826 | A | * | 1/1972 | Bowen et al. | 53/551 |
| 3,948,150 | A | * | 4/1976 | Hobart | 493/468 |
| 4,617,683 | A | * | 10/1986 | Christoff | 383/63 |
| 4,745,731 | A | * | 5/1988 | Talbott et al. | 53/551 |
| 4,909,017 | A | * | 3/1990 | McMahon et al. | 53/410 |
| 5,046,300 | A | * | 9/1991 | Custer et al. | 53/412 |
| 5,125,217 | A | * | 6/1992 | Fukuda | 53/551 |
| 5,127,208 | A | * | 7/1992 | Custer et al. | 53/551 |
| 5,235,794 | A | * | 8/1993 | Center | 53/451 |
| 5,255,495 | A | * | 10/1993 | Kovacs | 53/504 |
| 5,412,924 | A | | 5/1995 | Ausnit | |
| 5,505,037 | A | | 4/1996 | Terminella | |
| 5,564,259 | A | | 10/1996 | Stolmeier | |
| 6,006,501 | A | * | 12/1999 | Davis et al. | 53/551 |

(Continued)

FOREIGN PATENT DOCUMENTS

| | | | | | |
|---|---|---|---|---|---|
| DE | 10251070 | A1 | * | 5/2004 | B65B 9/22 |
| EP | 1442981 | A2 | * | 8/2004 | B65B 9/22 |
| JP | 03085208 | A | * | 4/1991 | B65B 9/22 |

OTHER PUBLICATIONS

International Search Report and Written Opinion mailed Mar. 26, 2013 for PCT Application No. PCT/US2013/020552 (7 pages).

*Primary Examiner* — Stephen F Gerrity

(74) *Attorney, Agent, or Firm* — Colin P. Cahoon; Stephen Y. Liu; Carstens & Cahoon, LLP

(57) ABSTRACT

An apparatus and method for reducing stress marks and pleats on a package. The apparatus includes the use of an elongated filling tube. The dimensions of the elongated filling tube reduce the stress on the film as it is being formed around the filling tube. Further, the dimensions of the elongated filling tube prevent the formation of pleats as the sealing jaws must travel a decreased distance to seal, and the filling tube cross section better resembles the final package.

12 Claims, 5 Drawing Sheets

(56) References Cited

U.S. PATENT DOCUMENTS

| | | | | |
|---|---|---|---|---|
| 6,088,998 | A * | 7/2000 | Malin et al. | 53/416 |
| 6,131,369 | A * | 10/2000 | Ausnit | 53/412 |
| 6,151,868 | A * | 11/2000 | Matthews | 53/451 |
| 6,314,706 | B1 * | 11/2001 | Araki et al. | 53/551 |
| 6,513,308 | B1 * | 2/2003 | Meeuwesen et al. | 53/551 |
| 6,588,177 | B1 * | 7/2003 | Melchoir | 53/551 |
| 6,652,436 | B1 * | 11/2003 | Yeager et al. | 493/213 |
| 6,675,558 | B2 * | 1/2004 | Kinigakis et al. | 53/412 |
| 6,691,491 | B2 | 2/2004 | Terminella | |
| 6,718,739 | B2 | 4/2004 | Kohl | |
| 7,007,440 | B2 * | 3/2006 | Kinoshita et al. | 53/551 |
| 7,191,575 | B2 * | 3/2007 | Frievalt et al. | 53/551 |
| 7,523,597 | B2 * | 4/2009 | Dominguez, Jr. et al. | 53/551 |
| 2002/0077238 | A1 * | 6/2002 | Buchman et al. | 493/394 |
| 2002/0177380 | A1 * | 11/2002 | Forman et al. | 442/366 |
| 2004/0163360 | A1 * | 8/2004 | Van Rens et al. | 53/133.4 |
| 2006/0111225 | A1 * | 5/2006 | Leighton | 493/213 |
| 2007/0084142 | A1 * | 4/2007 | Matthews | 53/412 |

* cited by examiner

FORM-FILL-SEAL MACHINE INCLUDING A FILLING TUBE WITH AN ELLIPTICAL CROSS-SECTION

BACKGROUND OF THE INVENTION

1. Technical Field

The present invention relates to an elliptical former as well as a method for reducing pleats, tucks, and stress marks.

2. Description of Related Art

Many consumers now desire that food packaging contain a resealable structure such that the packaging can be resealed for later use. These resealable structures have proven difficult to utilize in a vertical form, fill, and seal machine. Consequently, it is desirable to have a method and apparatus which can utilize a resealable structure on a vertical form, fill, and seal machine.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicants' invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
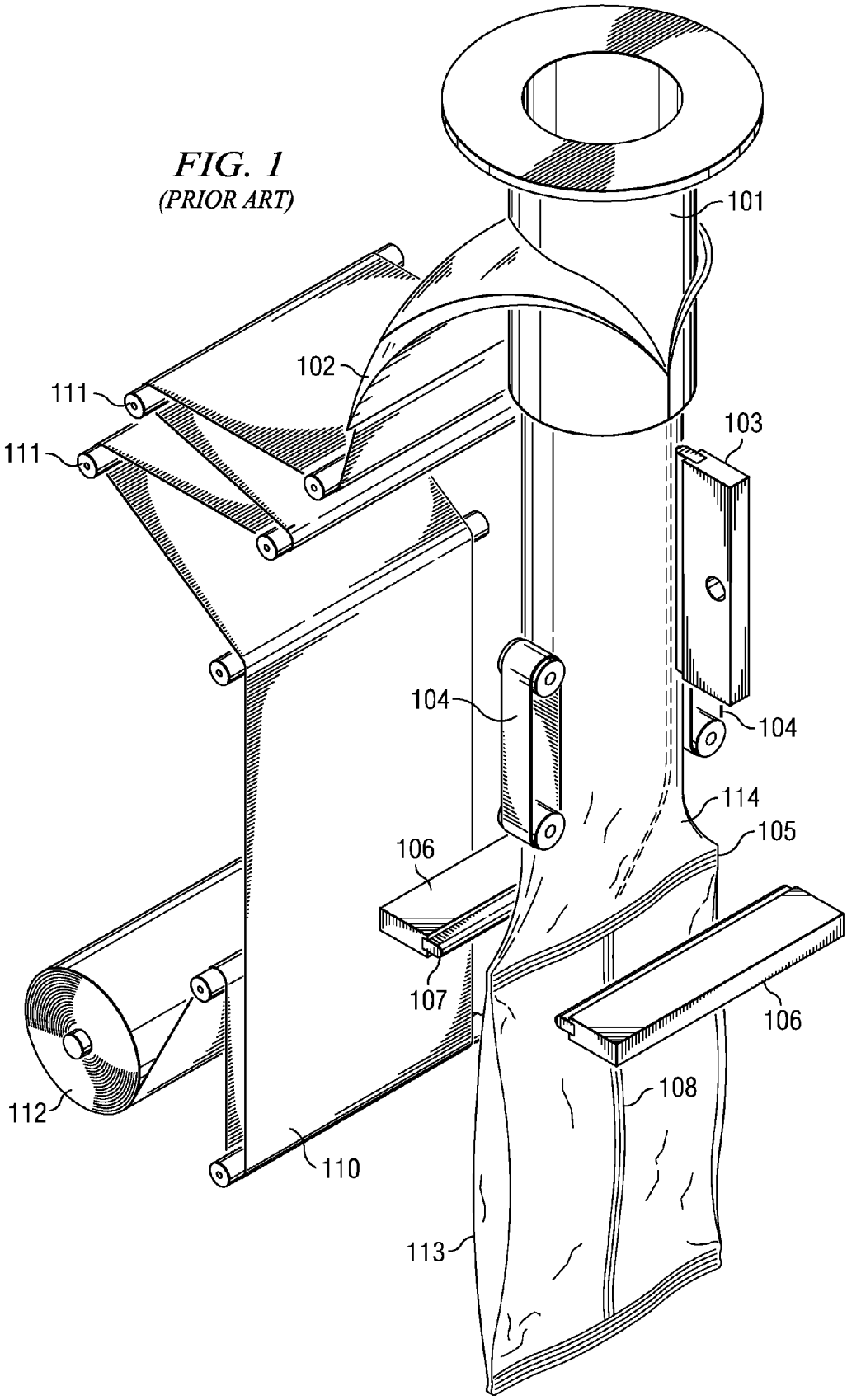
FIG. 1 (PRIOR ART)
FIG. 1 is a perspective view of a vertical form, fill, and seal machine.

Flexible packages can be produced by a variety of devices. These include horizontal and vertical form, fill, and seal machines. Film is fed into these machines, formed into a package, filled with product, and sealed. FIG. 1 shows an exemplary vertical form, fill, and seal machine that can be used to package snack foods, such as chips. This drawing is simplified, and does not show the cabinet and support structures that typically surround such a machine, but it demonstrates the working of the machine well. Packaging film 110 is taken from a roll 112 of film and passed through tensioners 111 that keep it taut. The film then passes over a former 102 which directs the film as it forms a vertical tube around a product filling tube 101. As depicted, the filling tube 101 has a round cross-section. As the tube of packaging material is pulled downward by drive belts 104, the edges of the film are sealed along its length by a vertical sealer 103, forming a back seal 108. The machine then applies a pair of heat-sealing jaws 106 and accompanying jaw face 107 against the tube to form a transverse seal 105. Different shapes of jaw faces 107 result in different shaped seals. The transverse seal 105 acts as the top seal on the bag 113 below the sealing jaws 106 and the bottom seal on the bag 114 being filled and formed above the sealing jaws 106. After the transverse seal 105 has been formed, a cut is made across the sealed area to separate the finished bag 113 below the seal 105 from the partially completed bag 114 above the seal. The film tube is then pushed downward to draw out another package length. Before the sealing jaws 106 form each transverse seal 105, the product to be packaged is dropped through the product delivery cylinder 101 and is held within the tube above the transverse seal 105.

As previously noted, consumers have desired re-sealable packages. Because of the prominence and efficiency of a vertical form, fill, and seal machine, it is desirable that the re-sealable packages be formed with a vertical form, fill, and seal machine.

Figure 2:
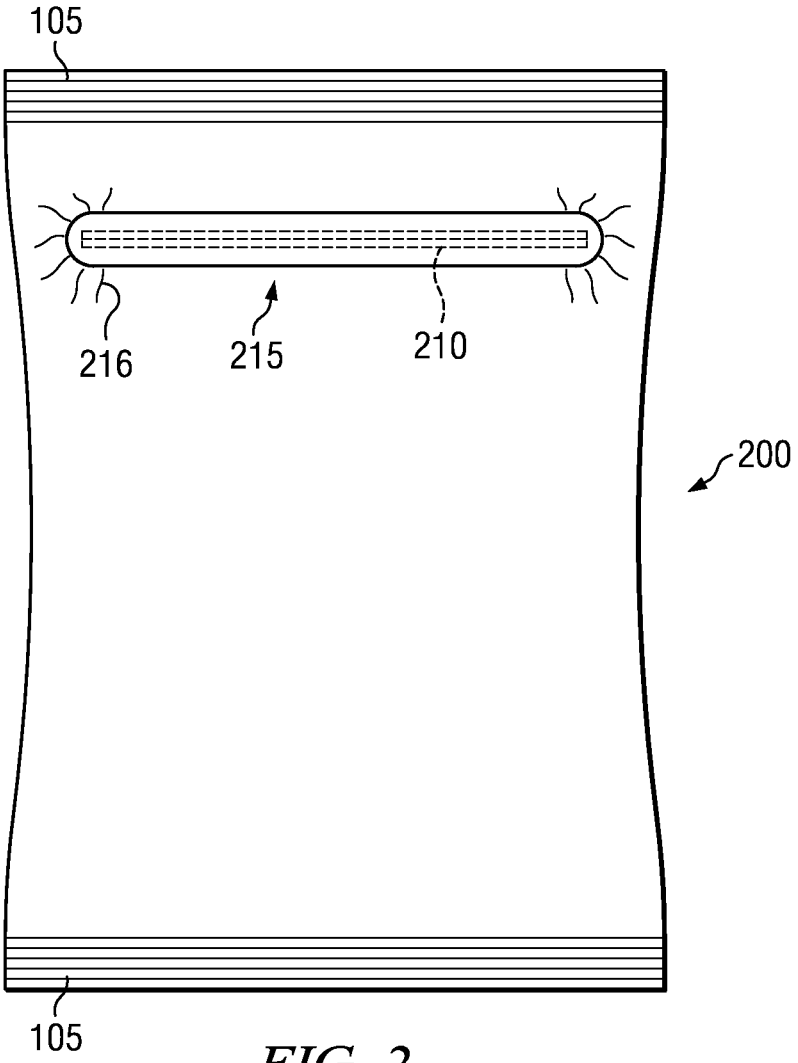
FIG. 2 depicts a top view of a formed package made with a vertical form, fill, and seal machine.

FIG. 2 depicts a top view of a formed package made with a vertical form, fill, and seal machine. The package 200 comprises the transverse seals 105 and a sealing device 215. The sealing device 215 can comprise any device known in the art which can be opened and resealed, including a zipper. Other sealing devices can include a die cut opening that is released with an outer applied layer. In another embodiment a cross-direction tin tie is utilized which is folded over to provide deadfold capability. As depicted the sealing device 215 comprises a zipper with removable protective cover. The protective cover protects the zipper from being accidentally opened or pierced, which would then compromise barrier properties. Furthermore, if the zipper or other device fails to provide the required barrier properties, such as oxygen or moisture barrier requirements, the removable protective cover can provide these barrier property requirements. As stated, however, the device is not limited to the sealing device described above as virtually any device which can be resealed can be used as a sealing device.

Also shown in FIG. 2 are stress marks 216. These are undesirable markings on the external layer of the film. Often these stress marks 216 appear to be score lines in the film which is cosmetically undesirably. Further, consumers may see such stress marks 216 as a package defect. Taken further, severe stress marks 216 can compromise the barrier properties of the film. This can allow a premature oxygen or moisture gain in the package which can degrade the product and shorten shelf life. Accordingly, these stress marks 216 should be decreased or eliminated.

Figure 3B:
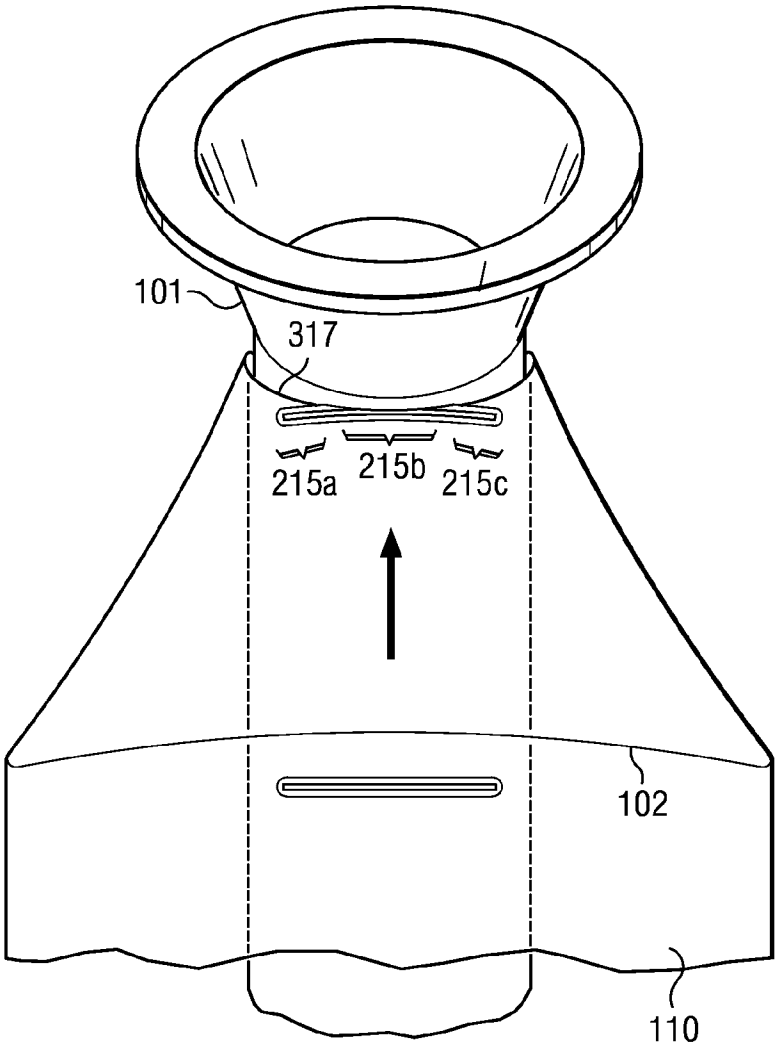
FIG. 3B is a front perspective view of a sealing device reaching a crown in one embodiment.
Figure 3A:
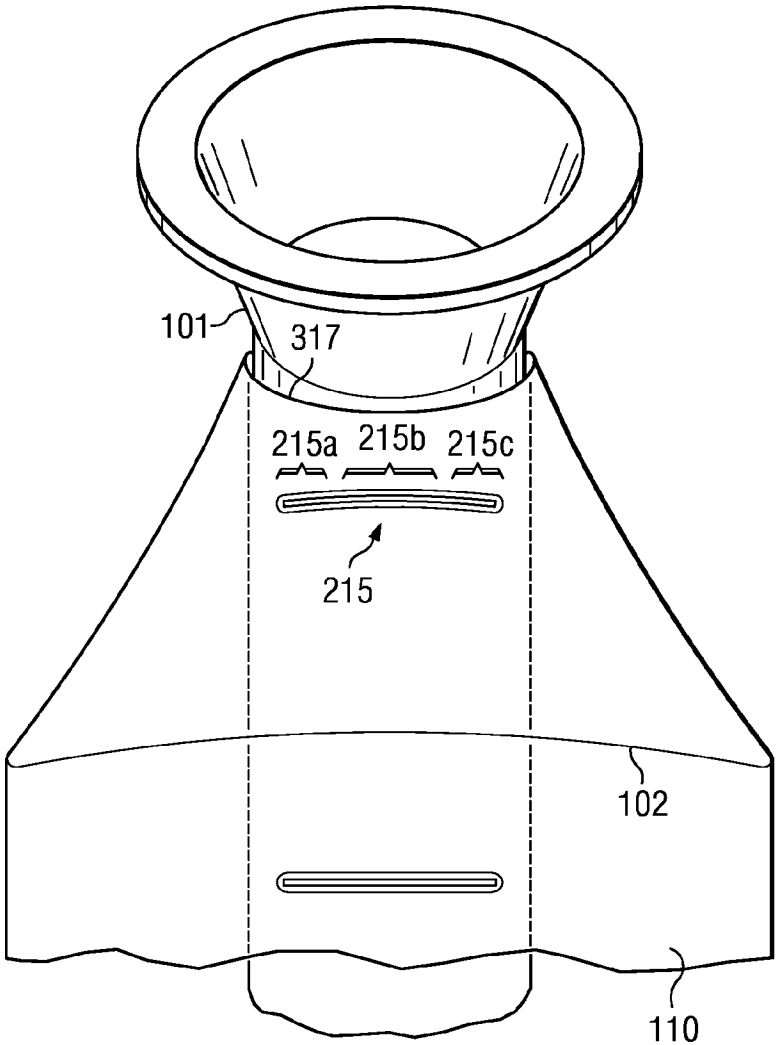
FIG. 3A is a front perspective view of film advancing to the filling tube in one embodiment.

It has been surprisingly found that the cross-section of the filling tube 101 and the shape of the former 102 and the crown 317 has a large effect on the formation of the stress marks 216. FIGS. 3A and 3B are front perspective views of film advancing to the filling tube in one embodiment. FIG. 3A is a front perspective view of film advancing to the filling tube in one embodiment. FIG. 3B is a front perspective view of a sealing device reaching a crown in one embodiment.

In FIG. 3A it can be seen that the film 110 is advancing toward the filling tube 101. It can also be seen that the sealing device 215 is also advancing toward the filling tube 101. For illustration purposes the sealing device 215 has been separated into three portions: a middle portion 215*b* and two end portions 215*a,c*. In practice, however, the sealing device 215 comprises a solid piece. The film is pulled downwardly across the crown 317 of the former 102. The crown 317 is the portion of the former 102 at which the film changes direction. In one embodiment the crown 317 has a transitionary shape. A transitionary shape refers to a shape which allows the film to transition to the shape of the filling tube 101. For example, in one embodiment the former comprises a flat surface to receive the film. Thereafter, the former uses a transitionary shape to transition the film from a flat surface to a desired shape. For example, if the filling tube 101 is circular, the crown 317 will have a similar shape which transitions the film to a circular shape. As can be seen in FIG. 3A, the filling tube 101 has a circular cross-section. Likewise, the former 102 directs film around the filling tube 101 so the crown 317 also has a circular shape.

FIG. 3B illustrates the point at which the sealing device 215 has reached the crown 317. It can be seen that the different portions of the sealing device 215*a,b,c* cross the crown 317 at different times. For example, the middle portion 215*b* of the sealing device 215 is across the crown 317 before the end portions 215*a,c*. Thus, the ends 215*a,c* of the sealing device 215 are getting pulled in upward direction whereas the middle portion 215*b* of the sealing device 215, which has already passed the crown 317, is being pulled in the downward direction. This results in increased strain in the film which results in stress marks 216. This is not typically a problem if a sealing device 215 is not utilized. However, the sealing device 215 often has a different elasticity compared to the film. Consequently, when the sealing device 215 crosses the crown at different times, the stress is directed to the film. As stated, this stress causes stress marks 216.

It has been surprisingly discovered that utilizing a filling tube 101 with an elliptical cross-section decreases or eliminates the stress marks 216. An elliptical shape allows most, if not all, of the sealing device 215 to cross the crown 317 at the same time. Without being limited to theory, it is believed the reason behind this benefit lies on the dimensions of the elliptical shape.

Figure 4A:
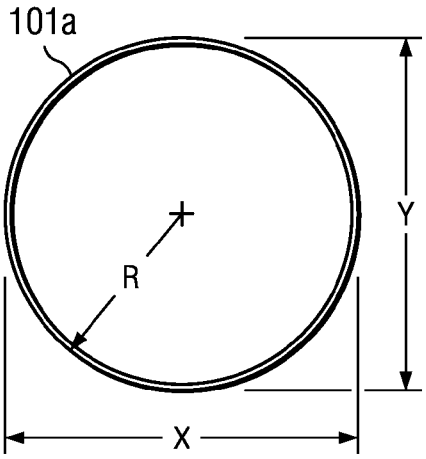
FIG. 4A is a top cross-sectional view of a circular filling tube.
Figure 4B:
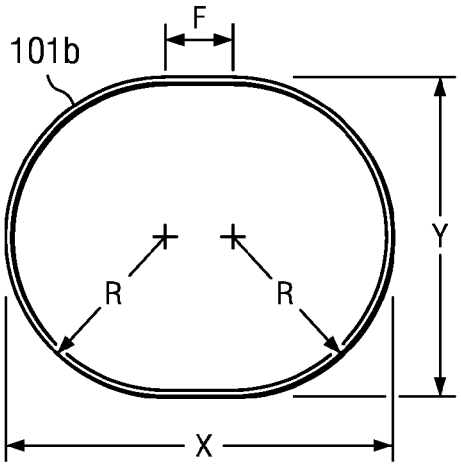
FIG. 4B is a top cross-sectional view of an oval filling tube.
Figure 4C:
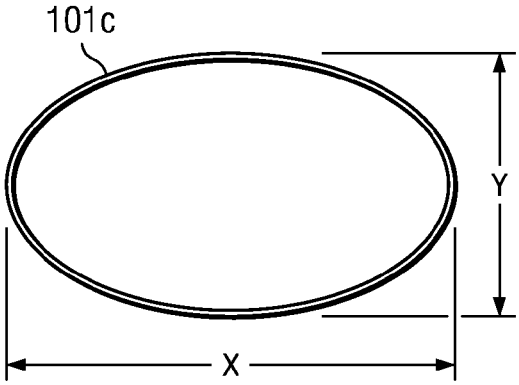
FIG. 4C is a top cross-sectional view of an elliptical filling tube.

FIGS. 4A-4C illustrate a top cross-sectional views of filling tubes of varying shape. FIG. 4A is a top cross-sectional view of a circular filling tube. The filling tube 101*a* has a radius R. For a nine-inch filling tube 101, the radius is approximately 5.73 inches. Accordingly, the length X to width Y ratio of the circular filling tube 101*a* is 1:1. As illustrated in FIGS. 3A and 3B, a circular filling tube 101*a* results in the sealing device 215 crossing the crown at different times which results in stress marks 216.

FIG. 4B is a top cross-sectional view of an oval filling tube. The oval filling tube 101*b* comprises a flat F a radius R. As depicted, and in one embodiment for the nine inch former, the oval filling tube 101*b* has a length X of 6.21 inches and a width X of 5.195 inches. Thus, the oval filling tube 101*b* depicted has a length X to width Y ratio of 6.211:5.195 or 1.2. The flat F represents the straight portion of the filling tube 101*b*. The oval filling tube 101*b* still has the disadvantages with stress marks 216 described above. Specifically, the middle portion 215*b* of the sealing device 215 accelerates and crosses the crown 317 faster than the end portions 215*a,c* of the sealing device 215 causing stress marks 216.

FIG. 4C is a top cross-sectional view of an elliptical filling tube. The elliptical filling tube 101*c*, as depicted, has a length X of approximately 7.15 inches and a width Y of approximately 4.10 inches for a nine inch former. This gives a length to width ratio of 7.15:4.1 or 1.74. When the elliptical filling tube 101*c* is utilized rather than the circular 101*a* or oval 101*b* filling tubes, the stress marks 216 are eliminated or at least substantially decreased. In one embodiment the circular 101*a* and oval 101*b* filling tubes resulted in 100% of the packages having undesirable stress marks 216. However, with the same packaging film, greater than 95% of packages manufactured with an elliptical filling tube 101*c* did not have stress marks 216. In other embodiments the stress marks 216 were completely eliminated.

As depicted in FIG. 4C, the elliptical filling tube 101*c* does not have a flat. However, due in part to the increased length to width ratio, the ends 215*a,c* of the sealing device reach the crown 317 at the same time as the middle portion 215*b* of the sealing device 215. This is due, in part, because the distance that the end portions 215*a,c* must travel to reach the crown 317 is decreased in the elliptical former. This decreased distance that the end portions 215*a,c* must travel is decreased because of the increased length to width ratio of the elliptical filling tube 101*c*. Accordingly, all portions 215*a,b,c* of the sealing device 215 reach and pass the crown 317 at the same time, or at approximately the same time. Because of this, the stress on the film is minimized compared to the prior art formers, and no stress marks 216 are produced.

It should be noted that while in one embodiment the filling tube 101 does not comprise a flat, in another embodiment the filling tube 101 comprises a flat along its width. While not depicted, referring to FIG. 4C, in one embodiment the filling tube 101*c* comprises a flat along the width Y whereas it does not comprise a flat along its length. Such a flat along its width Y allows for the presence of pull belts which can pull and direct the film. The flats can vary but in one embodiment they are about one inch long. If FIG. 4C was depicted as comprising a flat along its length that the curved sections located at the top and bottom of FIG. 4C would not comprise a flat whereas the left and right curved sections would also comprise a flat.

Figure 5B:
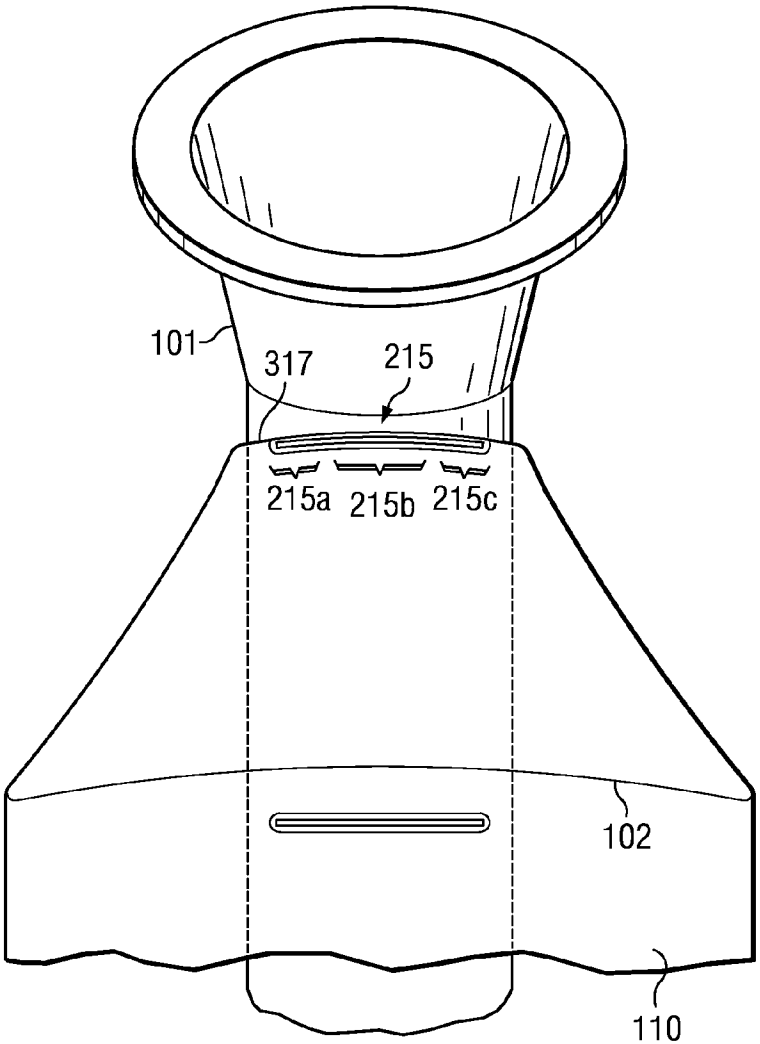
FIGS. 5A and 5B are front perspective views of a sealing device advancing to an elliptical filling tube in one embodiment.
Figure 5A:
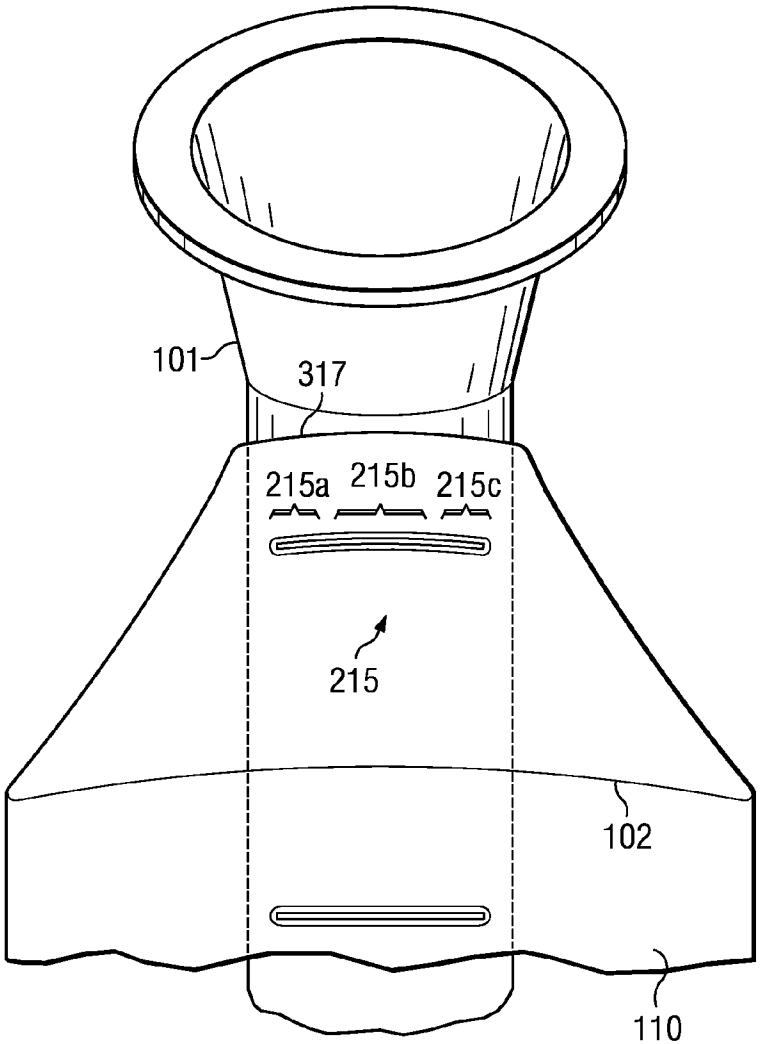

FIGS. 5A and 5B are front perspective views of a sealing device advancing to an elliptical filling tube in one embodiment. As can be seen, all portions 215*a,b,c* of the sealing device 215 reach and pass the crown 317 at the same time.

It should be noted that while one embodiment utilizing an elliptical filling tube has been described the invention is not so limited. Virtually any elongated filling tube can be utilized to avoid stress marks 216. As used herein an elongated filling tube refers to a filling tube which a cross section comprising a length to width ratio of 1.5 or greater, wherein length is measured as the longest dimension. In one embodiment the length lies in the same direction as the upper and lower seals 105 whereas the width lies in a direction perpendicular to the length. In one embodiment the elongated filling tube 101 comprises a length to width ratio of 1.7 or greater. As noted, in one embodiment the elongated filling tube comprises an elliptical cross-section. It should be noted that the cross-sectional shape described refers to the shape at the portion of the filling tube around which film is wrapped. Put differently, while the top of the filling tube 101, above the former 102, may have a dissimilar shape, such as a funnel, this does not affect the formation of the package. Furthermore, even if the filling tube 101 of FIG. 4C comprises a round funnel top, the filling tube 101 is still an elongated filling tube 101 because the portion around which film is wrapped has an elongated cross-section.

It should be noted that the product to be packaged has an effect on the maximum length to width ratio which can be utilized. For example, salty snacks such as potato chips will bridge or get lodged in a filling tube 101 if the filling tube 101 is too narrow. As an example, in one embodiment for salty snacks, the filling tube 101 comprises a width of at least ¼ of an inch greater than the maximum product dimension of the product being packaged to avoid bridging. The maximum product dimension is the largest measured length of a product in any dimension.

While an elongated filling tube 101 reduces stress marks 216 on packages comprising a sealing device 215, the elongated filling tube 101 also has unexpected advantages for packages regardless of whether they comprise a sealing device 215. First is the elimination or reduction of pleats or tucks. This is an advantage which is realized whether the package comprises a sealing device 215 or not. Traditional manufacturing of flexible packages sometimes results in undesirable pleats or tucks which prevent the package from properly sealing. These pleats or tucks result in an improper seal which allows nitrogen to leak and shortens the shelf life of the product. It has been discovered that these pleats result from a flat film being folded around a circular filling tube and then compressed. During this process small folds and tucks can form. If, however, an elongated filling tube is utilized, the pleats and tucks are significantly reduced. In the prior art manufacturing, pleats and tucks occurred in between 1% and 5% of the manufactured packages. These packages were discarded in quality control contributing to undesirable waste. Utilizing an elongated filling tube, the pleats and tucks are reduced to less than 1%. This results in decreased product and film waste which results in increased throughput.

Without being limited to theory, it is believed that the reason for this benefit is due in part to the fact that the sealing jaws 106 have a decreased distance in which to compress the film to form a seal. This is because by increasing the length to width ratio, the width is often decreased compared to a circular filling tube. Thus, the sealing jaws hit a comparatively flatter area and require decreased distance to create a seal. This provides decreased opportunity for a pleat or tuck to form. Furthermore, the elongated filling tube more resembles the cross section of the final flexible package, in one embodiment, as the final package is often longer than it is wide. There are less folding issues which arise if the forming tube more closely resembles the final package compared to a circular filling tube 101. Put differently, the film tube is already partially collapsed, and the film flows outward along the face of the seal jaws more readily compared to a circular filling tube 101.

One additional advantage is that because the seals must travel a decreased distance to seal the package, the seal travel time is decreased. The seal travel time is the time required for a pair of sealing jaws to open and reclose. Decreasing the seal travel time results in increased throughput and packaging efficiency. For an example, in one embodiment for a nine inch package, the seal jaws open to a maximum distance of 7.3 inches for a filling tube 101 with a circular cross-section. However, when an elongated filling tube 101, such as an elliptical filling tube 101, is utilized, the seal jaws are adjusted to open a maximum distance of 5.3 inches. Thus, the distance the sealing jaws must travel between seals is decreased by 2 inches. This reduces jaw travel time which can allow for increased dwell time, increased weld time, etc., which increases the efficiency of the package making process.

Accordingly, a vertical form, fill and seal machine comprising an elongate filling tube and a former has been described. The vertical form, fill and seal machine may further comprise any device typically associated with a vertical form, fill and seal machine including back sealers, transverse sealers, rollers, etc. Additionally, the elongate filling tube can be utilized in horizontal form, fill and seal machines.

The elongated filling tube can be used to prepare packages in vertical form, fill, and seal machines and horizontal form, fill, and seal machines as previously described. In one embodiment the package is formed by first feeding a film 110 to a former 102. As described, in one embodiment the former 102 has a flat surface for receiving the film and a transitionary shape for transitioning the film to the shape of the filling tube 101. In one embodiment the film comprises a sealing device 215 as previously discussed. In one embodiment the sealing device 215 is installed into the film 110 prior to being fed to the former 102.

Next, the film 110 is wrapped around the filling tube 101. Thereafter, a back seal is formed thus creating a tube around the filling tube 101. In one embodiment, the cross-section of the tube will be substantially similar to the cross-section of the filling tube 101. Next a lower seal is formed in any method known in the art. Thereafter product is introduced into the filling tube 101 and deposited into the partially formed package. Thereafter the upper seal is formed creating a final package. As noted, using an elongated filling tube 101 can result in a final package which does not comprise stress marks 216 or pleats.

While the invention has been particularly shown and described with reference to a preferred embodiment, it will be understood by those skilled in the art that various changes in form and detail may be made therein without departing from the spirit and scope of the invention.

ADDITIONAL DESCRIPTION

The following clauses are offered as further description of the disclosed invention.

1. A form, fill, and seal machine comprising:
   an elongated filling tube;
   a former.
2. The form, fill, and seal machine according to any preceding clause wherein said former further comprises a crown.
3. The form, fill, and seal machine according to any preceding clause wherein said former comprises a transitionary shape.
4. The form, fill, and seal machine according to any preceding clause wherein said elongated filling tube has a length to width ratio of greater than 1.5.
5. The form, fill, and seal machine according to any preceding clause wherein said elongated filling tube has a length to width ratio of greater than 1.7.
6. The form, fill, and seal machine according to any preceding clause wherein said elongated filling tube has an elliptical cross-section.
7. The form, fill, and seal machine according to any preceding clause wherein said machine comprises a vertical form, fill, and seal machine.
8. The form, fill, and seal machine according to any preceding clause wherein said machine comprises a horizontal form, fill, and seal machine.
9. The form, fill, and seal machine according to any preceding clause further comprising a product, wherein said product comprises a maximum dimension, and wherein said filling tube comprises a width greater than said maximum dimension plus at least ¼ of an inch.
10. A method of forming a package, said method comprising the steps of:
    a. feeding a film to a former;
    b. wrapping said film around a filling tube, wherein said filling tube comprises an elongated filling tube;
    c. forming a back seal to create a tube;
    d. forming a lower seal;
    e. introducing product;
    f. forming an upper seal to create a final package.
11. The method according to clause 10 wherein said film comprises a sealing device.
12. The method according to clause 11 wherein said final package does not comprise stress marks.
13. The method according to clauses 10-12 wherein said filling tube comprises an elliptical cross-section.

14. The method according to clauses 10-13 wherein said final package does not comprise pleats.
15. The method according to clauses 10-14 wherein said elongate filling tube has a length to width ratio of greater than 1.5.
16. The method according to clauses 10-15 wherein said product of step e) comprises a maximum dimension, and wherein said elongated filling tube comprises a width that is greater than said maximum dimension plus at least ¼ of an inch.
17. The method according to clauses 10-16 wherein said elongate filling tube has a length to width ratio of greater than 1.7.

What is claimed is:

1. A form, fill, and seal machine comprising:

a former having a transitionary shape and including a crown;

an elongated filling tube that receives film from the former, wherein the film comprises a sealing device, and wherein:

the elongated filling tube comprises an elliptical cross-section having a length longer than a width, and wherein the shape of the crown is similar to the elliptical cross section of the elongated filling tube;

edges associated with the length are entirely arcuate; and the elliptical cross-section of the elongated filling tube and the shape of the crown allow all portions of the sealing device to reach and pass the crown at substantially the same time.

2. The form, fill, and seal machine of claim 1 wherein the cross-section of said elongated filling tube has a length to width ratio of greater than 1.5.

3. The form, fill, and seal machine of claim 1 wherein the cross-section of said elongated filling tube has a length to width ratio of greater than 1.7.

4. The form, fill, and seal machine of claim 1 wherein said machine comprises a vertical form, fill, and seal machine.

5. The form, fill, and seal machine of claim 1 wherein said machine comprises a horizontal form, fill, and seal machine.

6. The form, fill, and seal machine of claim 1 further comprising a product, wherein said product comprises a maximum dimension, and wherein said filling tube comprises a width greater than said maximum dimension plus at least ¼ of an inch.

7. A method of forming a package, said method comprising the steps of:

a. feeding a film to a former having a transitionary shape and including a crown, the film comprising a sealing device;

b. wrapping said film around a filling tube, wherein:

said filling tube comprises an elongated filling tube comprising an elliptical cross-section having a length longer than a width;

edges associated with the length are entirely arcuate;

the shape of the crown is similar to the elliptical cross-section of the filling tube;

the elliptical cross-section of the elongated filling tube and the shape of the crown allow all portions of the sealing device to reach and pass the crown at substantially the same time;

c. forming a back seal in the film to create a tube;

d. forming a lower seal in the tube;

e. introducing product into the tube;

f. forming an upper seal in the filled tube to create a final package.

8. The method of claim 7 wherein said final package does not comprise stress marks.

9. The method of claim 7 wherein said final package does not comprise pleats.

10. The method of claim 7 wherein said elongate filling tube has a length to width ratio of greater than 1.5.

11. The method of claim 7 wherein said product of step e) comprises a maximum dimension, and wherein said elongated filling tube comprises a width that is greater than said maximum dimension plus at least ¼ of an inch.

12. The method of claim 7 wherein said elongate filling tube has a length to width ratio of greater than 1.7.

* * * * *